US008544127B2

(12) United States Patent
Hsieh

(10) Patent No.: US 8,544,127 B2
(45) Date of Patent: Oct. 1, 2013

(54) FOOT SUPPORT DEVICE

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 0 days.

(21) Appl. No.: 13/493,424

(22) Filed: Jun. 11, 2012

(65) Prior Publication Data

US 2013/0219625 A1 Aug. 29, 2013

(30) Foreign Application Priority Data

Feb. 24, 2012 (TW) ..... 101106237 A

(51) Int. Cl.
*A47C 17/86* (2006.01)

(52) U.S. Cl.
USPC ..... 5/648; 5/630

(58) Field of Classification Search
USPC ..... 5/648–651, 621, 624; 128/869–870, 128/882; 603/32, 33, 36; 403/109.2, 109.3, 403/109.6, 378, 379.2, 384, 391, 398, 399, 403/400
See application file for complete search history.

(56) References Cited

U.S. PATENT DOCUMENTS

| | | | | |
|---|---|---|---|---|
| 4,373,709 | A * | 2/1983 | Whitt | 5/650 |
| 5,290,220 | A * | 3/1994 | Guhl | 602/33 |
| 6,012,456 | A * | 1/2000 | Schuerch | 128/869 |
| 2007/0143925 | A1 * | 6/2007 | Paul et al. | 5/624 |

* cited by examiner

*Primary Examiner* — Robert G Santos
*Assistant Examiner* — Richard G Davis
(74) *Attorney, Agent, or Firm* — Guice Patents PLLC

(57) ABSTRACT

A foot support device applicable to a surgery table for locating and supporting a patient's foot, which includes: a main body; a space being formed in the main body; a bottom end of the main body being connectable to the surgery table; an operation member up and down movably fitted around the main body, the operation member having an insertion pin therein; and a support including a bracket and at least one support body; an insertion hole is formed on the bracket. The bracket is rotatably mounted in the space of the main body. When the operation member is moved downward, the insertion pin is inserted into the insertion hole of the bracket to fix the support. By means of rotating the operation member, the operation member can be latched with the main body.

20 Claims, 10 Drawing Sheets

FOOT SUPPORT DEVICE

BACKGROUND OF THE INVENTION

1. Field of the Invention

The present invention relates generally to a device for locating and supporting a foot, and more particularly a foot support device for locating and supporting a patient's foot with the knee in a bent state to facilitate the knee operation.

2. Description of the Related Art

When performing a knee operation, a patient's knee must be bent and kept fixed. Therefore, a device or an implement is mounted on the surgery table for fixing the patient's foot with the knee in a bent state.

The conventional foot fixing device generally has a quite complicated structure and is inconvenient to operate.

Moreover, the conventional foot fixing device has a support member for a patient's foot to rest thereon. Some foot fixing devices have different support members with respect to left and right feet. That is, when fixing the left foot, it is necessary to selectively use a fixing device specifically designed for the left foot, while when fixing the right foot, it is necessary to selectively use a fixing device specifically designed for the right foot. Therefore, such foot fixing device cannot be commonly used for both left and right feet. As a result, it is inconvenient to use such foot fixing device.

SUMMARY OF THE INVENTION

It is therefore a primary object of the present invention to provide a foot support device for locating and supporting a patient's foot during a knee operation. The foot support device is convenient to operate and use.

It is a further object of the present invention to provide a foot support device, which can be switched between two directions for supporting a left foot or a right foot. In addition, the switch of the foot support device between the directions can be conveniently and quickly performed.

The foot support device of the present invention includes: a main body; a space being formed in the main body, the space passing through the main body between two sides thereof; an annular groove being formed on an outer circumference of the main body; a bottom end of the main body being connectable to a surgery table; an operation member, which is a sleeve member, at least one engagement block being disposed on an inner circumference of the operation member; an insertion pin being fixedly disposed in the operation member; the operation member being fitted around the main body and up and down movable along the main body; and a support including a bracket and at least one support body disposed on one side of the bracket; an insertion hole being formed on the bracket; the bracket being rotatably mounted in the space of the main body.

When the operation member is moved downward, a bottom end of the insertion pin is inserted into the insertion hole of the bracket to fix the support. A user can rotate the operation member to move the engagement block into the annular groove so as to latch the operation member with the main body.

After the support is released from the latched state, the support can be freely rotated. In this case, the user can switch the support bodies of the support between a left side and a right side of the foot support device for fixing the patient's left foot or right foot.

The present invention can be best understood through the following description and accompanying drawings, wherein:

DETAILED DESCRIPTION OF THE PREFERRED EMBODIMENT

Figure 1:
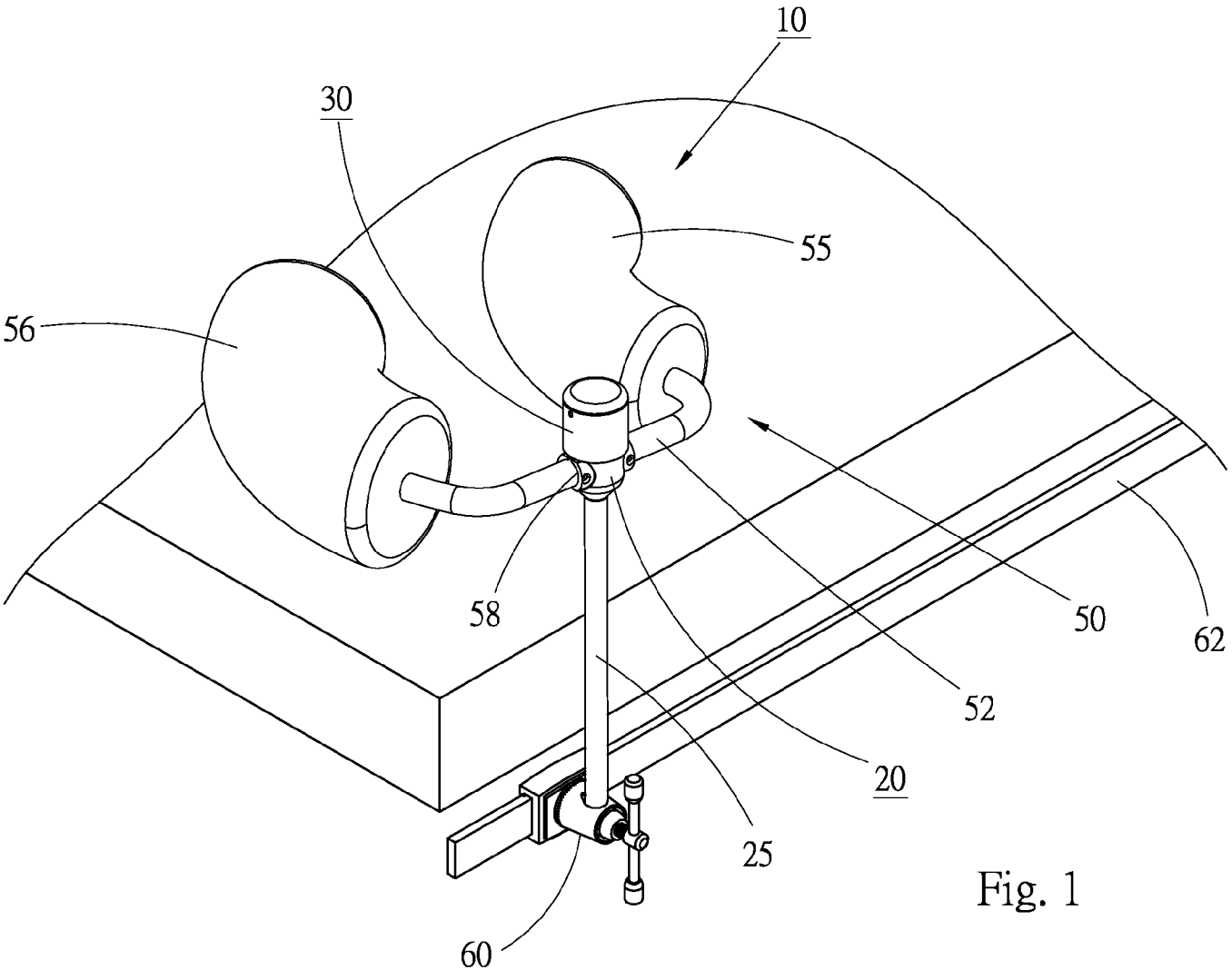
FIG. 1 is a perspective view of a preferred embodiment of the foot support device of the present invention.
Figure 2:
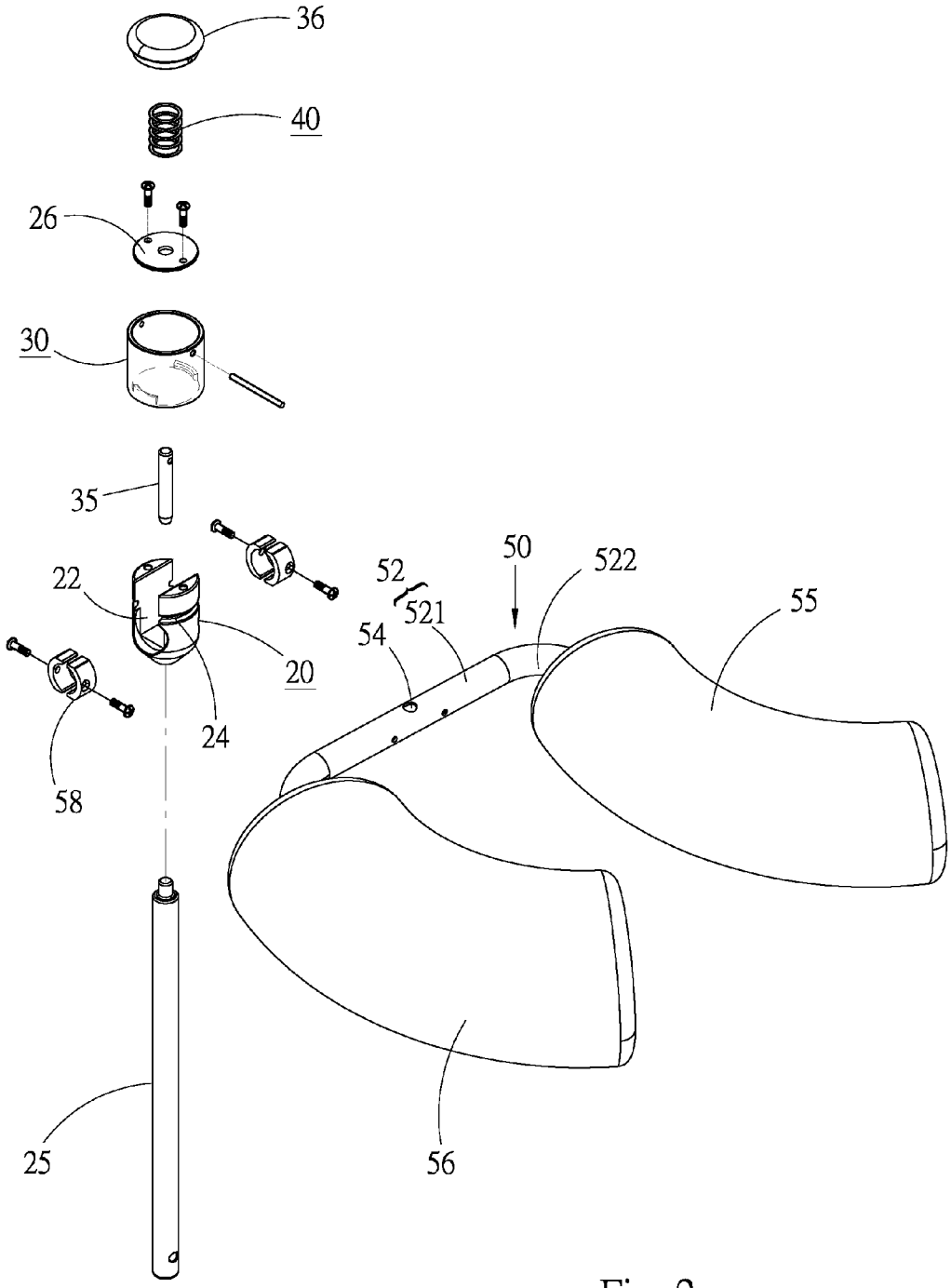
FIG. 2 is a perspective exploded view according to FIG. 1.
Figure 3:
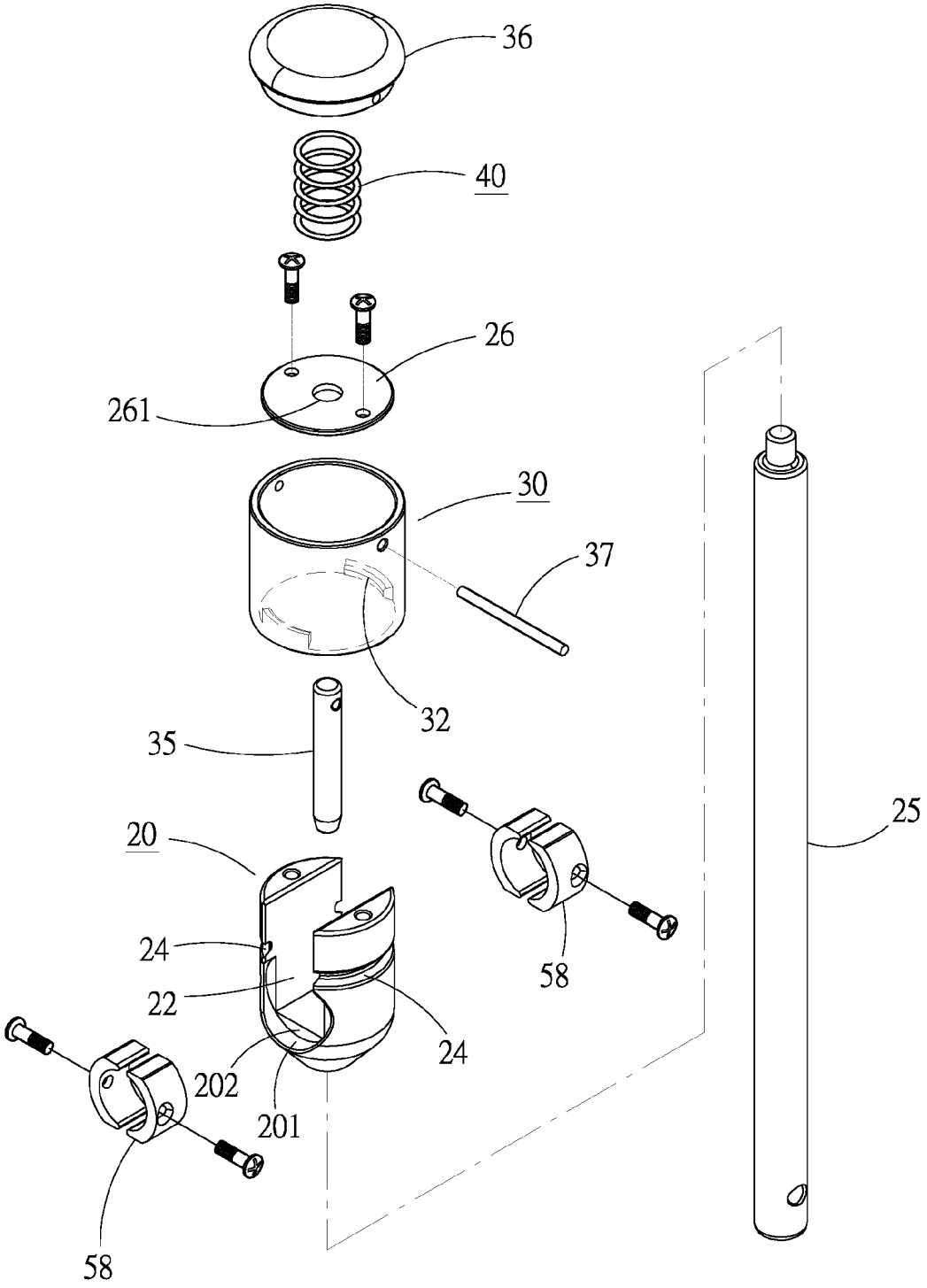
FIG. 3 is a perspective exploded view of some components of FIG. 2.
Figure 11:
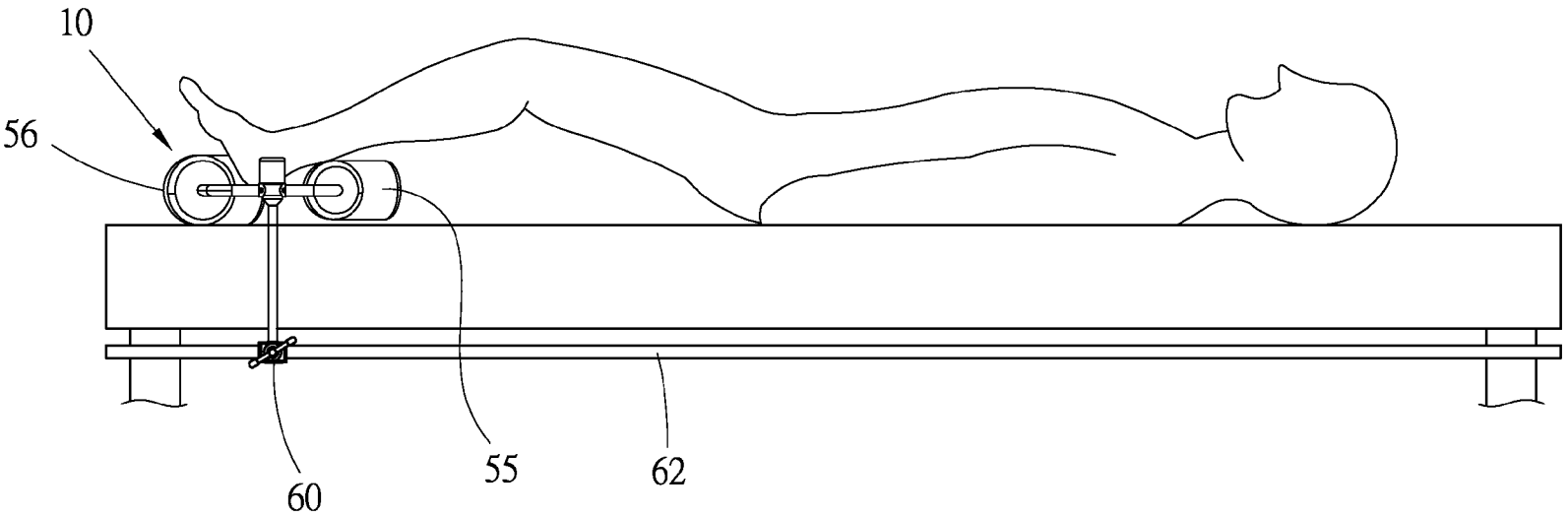
FIG. 11 is a side view showing that a patient's foot is supported on the foot support device of the present invention.

Please refer to FIG. 1. According to a first embodiment, the foot support device 10 of the present invention serves to support a patient's foot with the patient's knee bent when the patient is having a knee operation as shown in FIG. 11. Referring to FIGS. 2 and 3, the foot support device 10 includes a main body 20, an operation member 30, an elastic member 40 and a support 50.

The main body 20 has the form of a column or a cylinder. A space 22 is formed in the main body 20. The space 22 passes through the main body between two sides thereof, whereby each of the two sides of the main body is formed with an opening. In this embodiment, the space further upward extends to a top end of the main body 20. An annular groove 24 is formed on an outer circumference of the main body in communication with the openings of the two sides of the main body. A seat section in a necessary form is disposed at a bottom end of the main body 20 for installing the support device 10 on a surgery table. In this embodiment, the seat section is a connection rod 25. A top end of the connection rod 25 is fixedly connected to the bottom end of the main body by means of such as thread connection or plug-in connection. A top board 26 is fixedly connected to the top end of the main body 20 by means of two screws. A circumference of the top board serves as a stop flange around the top end of the main body.

The operation member 30 is a sleeve member. At least one or two engagement blocks 32 are disposed on an inner circumference of the operation member 30, and preferably on the inner circumference of a bottom end of the operation member 30. The two engagement blocks 32 are angularly spaced from each other by 180 degrees. An insertion pin 35 is vertically fixedly disposed in the operation member 30. To speak more specifically, referring to FIG. 5, the operation member 30 further includes a top cap 36 and a pin member 37. The top cap 36 is disposed at the top end of the operation member. A top end of the insertion pin 35 is fitted in a socket 361 formed under a bottom side of the top cap 36. The pin member 37 passes through the circumferential wall of the operation member 30, the top cap 36 and the top end of the insertion pin 35 so as to fix the insertion pin in the operation member. The top cap 36 serves as a top wall of the operation member. The manner in which the insertion pin is fixedly disposed in the operation member is not limited to the above embodiment.

Figure 4:
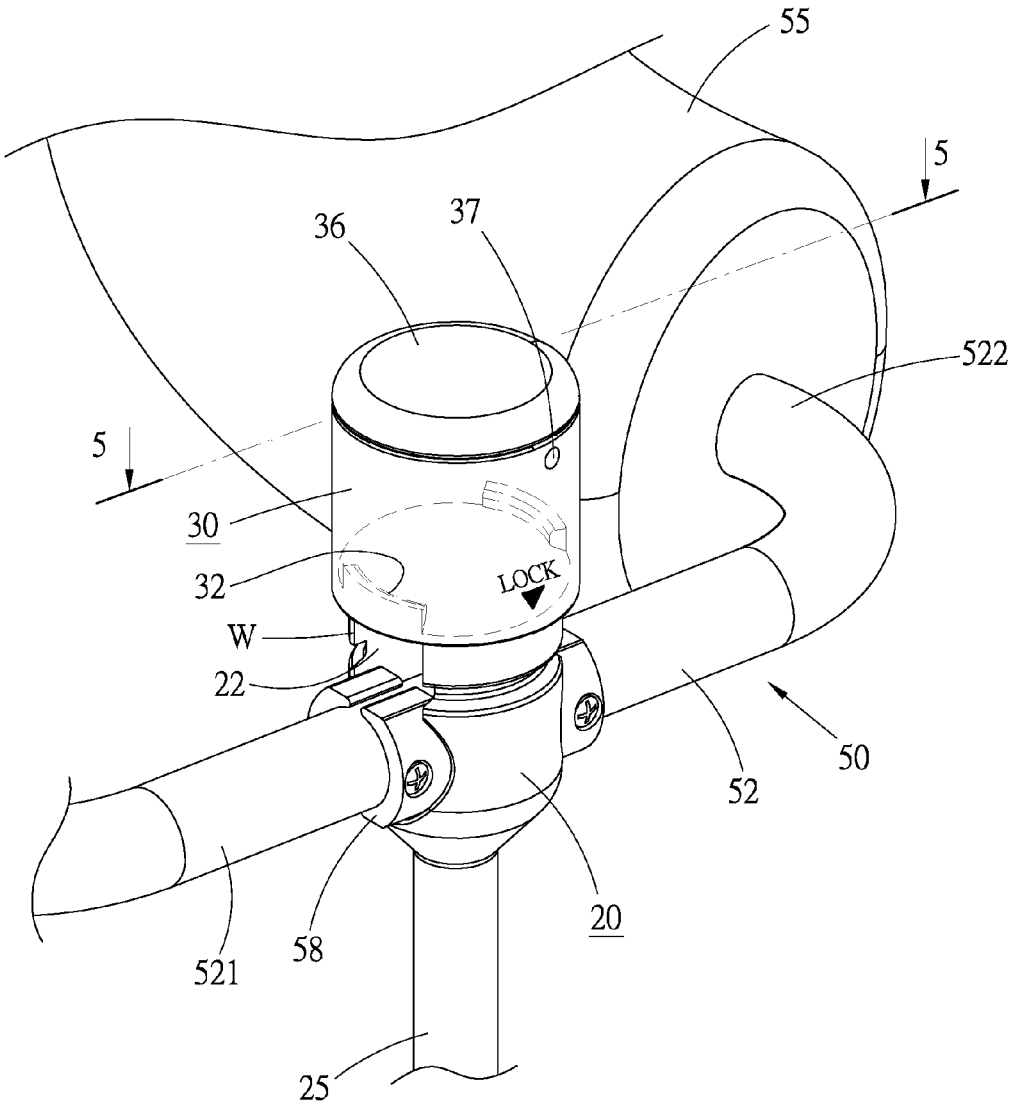
FIG. 4 is an enlarged view of a part of the preferred embodiment of the foot support device of the present invention, showing that the support device is in an unlocked state.
Figure 5:
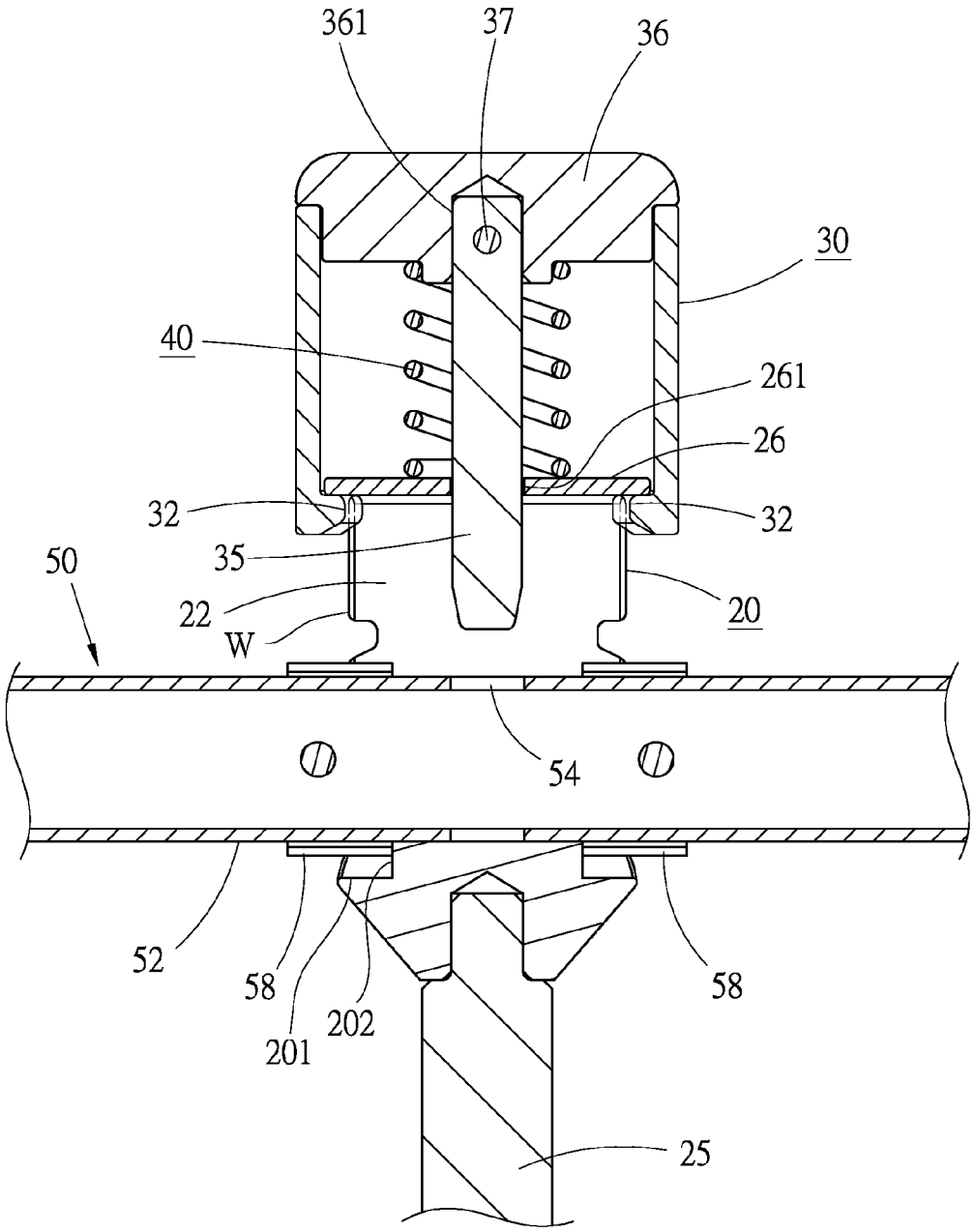
FIG. 5 is a sectional view taken along line 5-5 of FIG. 4.

The operation member 30 is fitted around the main body 20. A bottom end of the insertion pin 35 passes through a through hole 261 of the top board 26 and is positioned in the space 22 of the main body. When the operation member 30 is positioned in an angular position as shown in FIGS. 4 and 5, the two engagement blocks 32 are right aligned with the openings of the two sides of the main body 20. Under such circumstance, the operation member can be moved up and down along the main body 20. In this embodiment, when the engagement blocks 32 are stopped by two sidewalls w of the openings, the operation member 30 cannot be rotated.

The elastic member 40 is a compression spring installed in the operation member 30. One end of the elastic member 40 abuts against the top end of the main body 20, while the other end of the elastic member 40 abuts against the top cap 36 of the operation member 30. When the operation member is positioned in a position as shown in FIGS. 4 and 5 and is free from any external pressing force, the elastic member 40 upward pushes the operation member and keeps the operation member moved upward. When the engagement blocks 32 are stopped by the stop flange of the top end of the main body 20, (that is, the circumference of the top board 26), the operation member is positioned in an upper dead end without detaching from the main body.

Please refer to FIG. 2. The support 50 includes a bracket 52 and more than one, for example, two soft support bodies 55, 56. The bracket 52 is U-shaped and has a straight main bar section 521 and two ends 522. The two support bodies 55, 56 are substantially barrel-shaped bodies having an arched form with one side concave, while the other side convex. The concave side is for contacting with a patient's sole. Each support body has internal foam rubber and a skin layer enclosing the foam rubber. The two support bodies are respectively fixedly disposed at two ends 522 of the bracket 52 and forward and backward arranged on the same side of the main bar section 521. The two support bodies have different sizes. The front support body 55 has a smaller diameter, while the rear support body 56 has a larger diameter. An insertion hole 54 is formed through the main bar section 52 of the bracket. The axial direction of the insertion hole 54 is vertical to the longitudinal direction of the two support bodies 55, 56, that is, when the two support bodies 55, 56 are horizontally positioned, the insertion hole is vertically positioned.

The bracket 52 of the support 50 is mounted in the space 22 of the main body 20, and the bracket 52 is rotatable in the space 22 with the insertion hole 54 positioned right under the insertion pin 35. The support 50 further includes two restriction members 58 fixedly disposed on the bracket 52 and positioned on two sides of the main body 20 respectively. Each restriction member 58 is a ring body or composed of two semicircular bodies. A recess 201 is formed at each of the openings of the two sides of the main body 20. An inner wall face of the recess 201 is formed with a stepped section 202. An inner end of the restriction member 58 extends into the recess 201 to abut against the stepped section 202 so as to hinder the support 50 from sliding.

Referring to FIG. 1, in use of the present invention, the seat section 25 of the support device 10 is mounted on a chuck device 60. The chuck device is movable along a guide rail 62 of the surgery table and fixable in a desired position. The chuck device 60 is not included in the scope of the present invention and thus will not be further described hereinafter.

Figure 6:
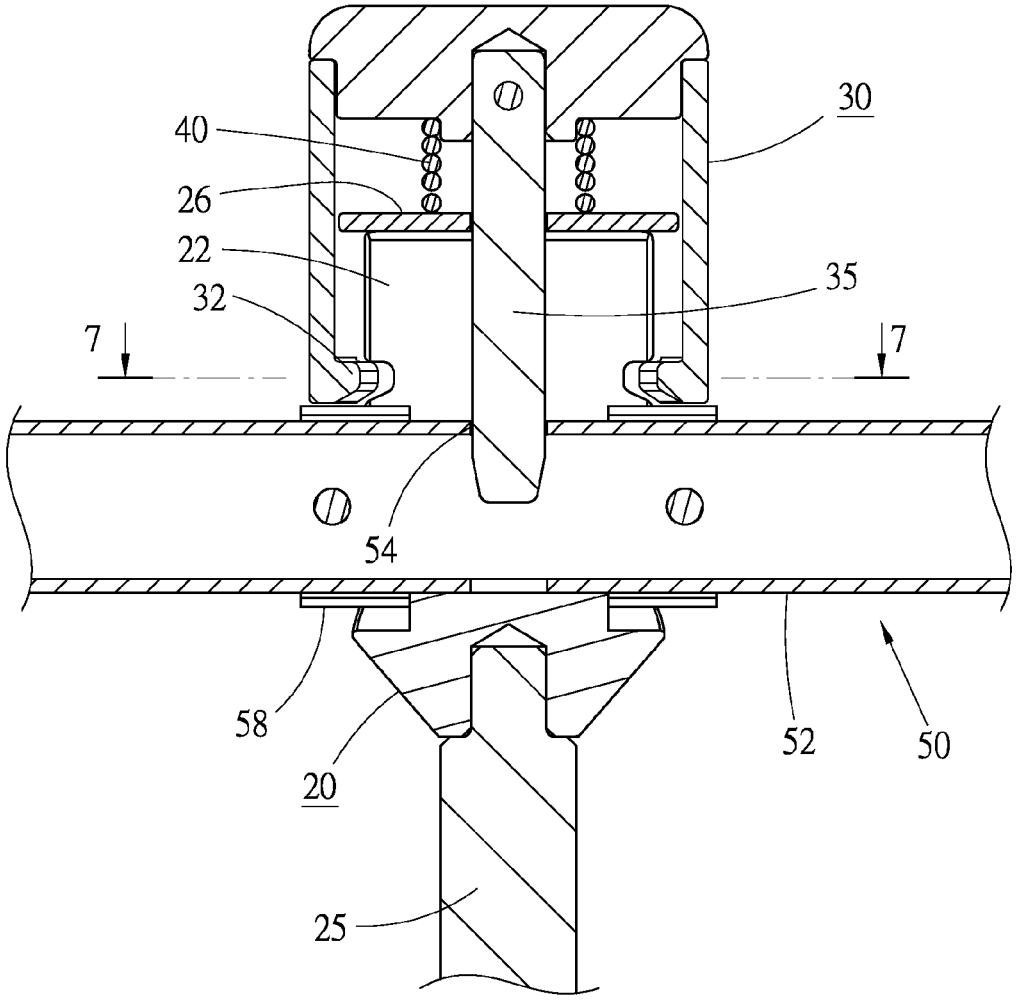
FIG. 6 is a sectional view according to FIG. 5, showing that the operation member is moved downward to an insertion position.

When the support device 10 is positioned in a released position as shown in FIGS. 4 and 5, the support 50 is not locked. When it is desired to lock the support 50, the two support bodies 55, 56 of the support 50 are turned on one side with the insertion hole 54 of the bracket 52 positioned in a vertical position. Then the operation member 30 is downward pressed to an insertion position as shown in FIG. 6. At this time, the insertion pin 35 is synchronously moved with the operation member, whereby the bottom end of the insertion pin 35 is inserted through one end of the insertion hole 54 into the bracket 52. Under such circumstance, the bracket is locked without possibility of rotation and the elastic member 40 is compressed. In this case, the two engagement blocks 32 are moved to a position where the annular groove 24 of the main body 20 is positioned as shown in FIGS. 6 and 7, whereby the two engagement blocks 32 can be moved into the annular groove.

Figure 8:
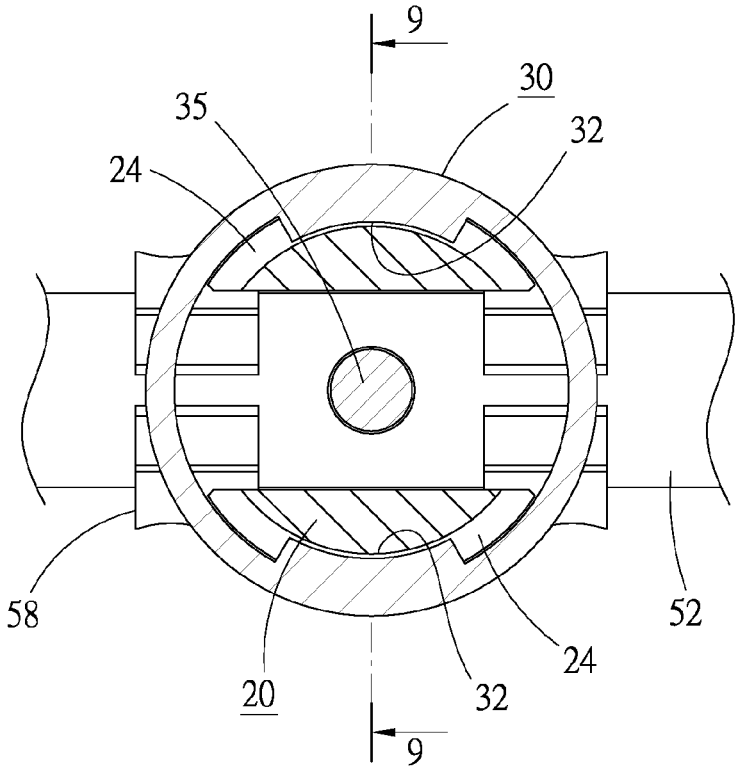
FIG. 8 is a sectional view according to FIG. 7, showing that the operation member is rotated to a latched position.
Figure 9:
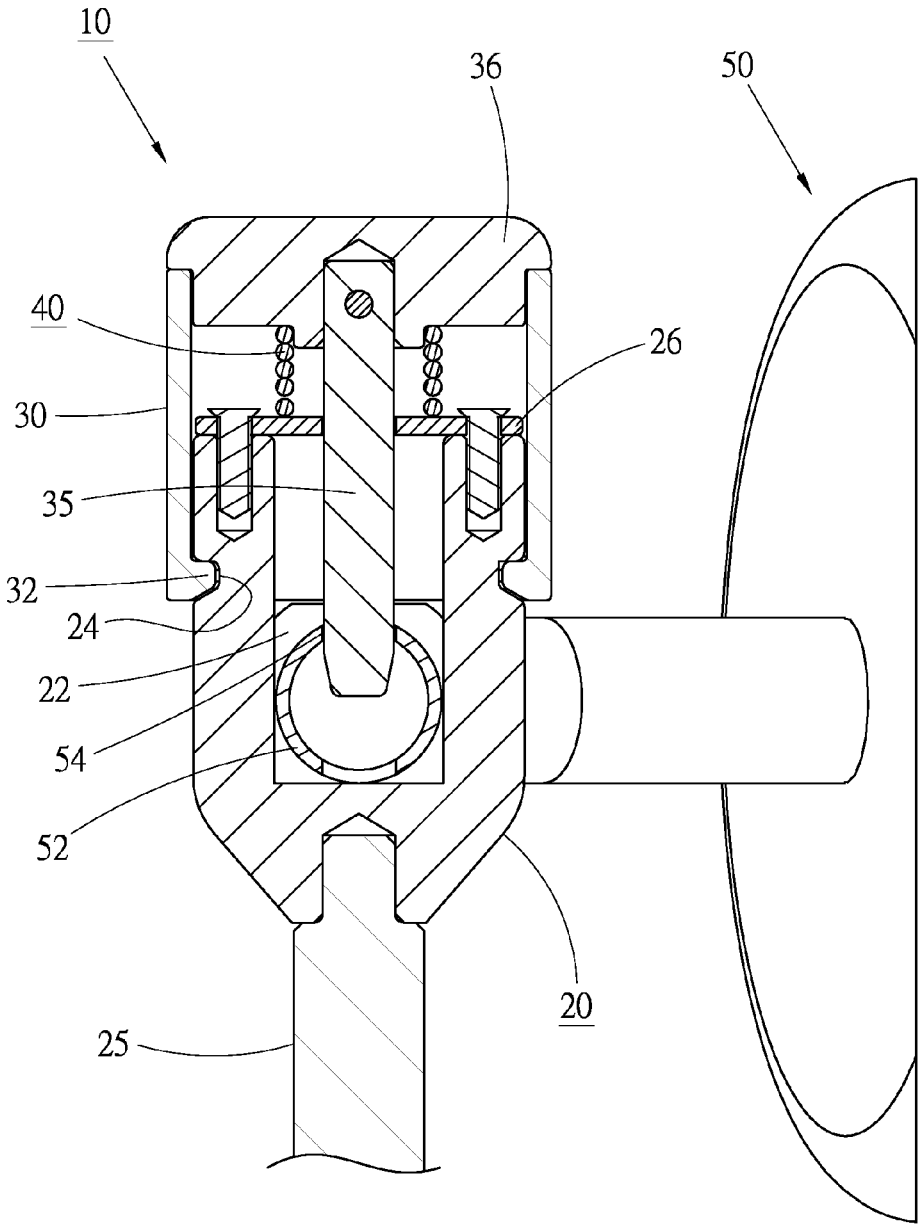
FIG. 9 is a sectional view taken along line 8-8 of FIG. 9.
Figure 10:
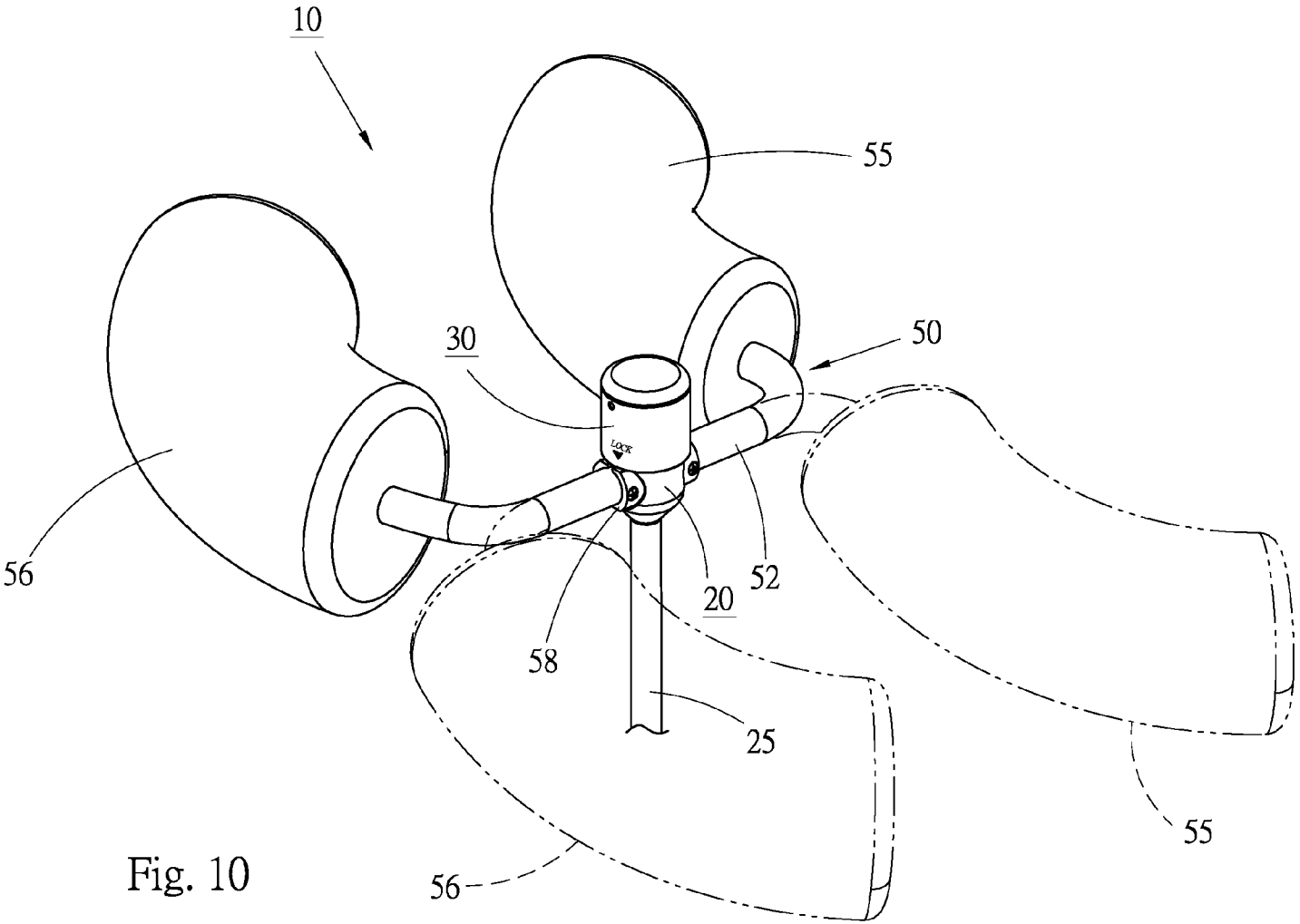
FIG. 10 is a perspective view according to FIG. 8.

Then an operator can 90 degrees rotate the operation member 30 to a latched position as shown in FIGS. 8 to 10 to move the two engagement blocks 32 from the openings of the main body into the annular groove 24 to latch with the annular groove 24. Under such circumstance, the operation member 30 is latched with the main body 20 to keep the insertion pin 35 locked with the bracket 52. Accordingly, the support 50 is fixedly located and the patient's foot can be located and supported on the support device 10 with the knee in a bent state to facilitate the knee operation as shown in FIG. 11.

Figure 7:
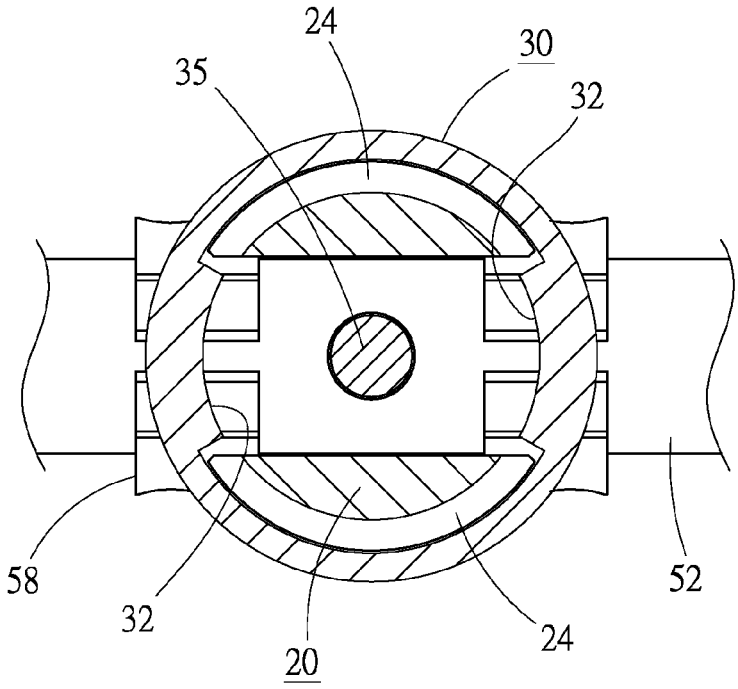
FIG. 7 is a sectional view taken along line 7-7 of FIG. 6.

When it is desired to release the support device from the latched state, the operation member 30 is further 90 degrees rotated to move the two engagement blocks 32 out of the annular groove 24 as shown in FIG. 7. Under such circumstance, the operation member is unlatched with the main body 20 and the elastic member 40 applies an elastic force to the operation member to upward move the operation member back to the released position as shown in FIG. 5. In this case, the insertion pin 35 is moved out of the insertion hole 54 of the bracket 52 without latching with the support 50, permitting the support 50 to rotate.

The solid lines of FIG. 10 show that the two support bodies 55, 56 are positioned on one side of the support device 10. At this time, one foot, such as the left foot of the patient can be supported. However, the present invention can be also used to support the other foot, such as the right foot of the patient. After the support 50 is released from the latched state (into the released state as shown in FIGS. 4 and 5), the support can be freely rotated. In this case, the operator can rotate the support 50 to move the two support bodies 55, 56 to the other side of the support device 10 as shown by the phantom lines of FIG. 10. Then the support 50 is again latched (with the insertion pin 35 inserted in the other end of the insertion hole 54 of the bracket 52). Accordingly, the two support bodies can be switched between two positions for use of left foot or right foot.

In use of the support device 10 of the present invention, a user only needs to press and rotate the operation member 30 for latching with or releasing the support 50. It is easy and convenient to operate the support device 10. In addition, the support device 10 of the present invention has a simple structure and is easy to manufacture.

Moreover, the support device 10 of the present invention can be used to support left foot or right foot so that the usage of the support device 10 of the present invention is widened. Furthermore, the two support bodies can be conveniently switched between two positions for use of left foot or right foot.

The above embodiment is only used to illustrate the present invention, not intended to limit the scope thereof. Many modifications of the above embodiment can be made without departing from the spirit of the present invention. For example, the operation member can be connected and latched with the main body in another manner.

What is claimed is:

1. A foot support device comprising:

a main body; a space being formed in the main body, two sides of the main body being located on opposing sides of the main body; each of the two sides of the main body is formed with an opening communicating with the space; an annular groove being formed on an outer circumference of the main body; a seat section being disposed at a bottom end of the main body;

an operation member, which is a sleeve member, at least one engagement block being disposed on an inner circumference of the operation member; an insertion pin being fixedly disposed in the operation member; the operation member being fitted around the main body and up and down movable along the main body;

an elastic member disposed between the operation member and the main body, in normal state, the elastic member pushing the operation member to keep the operation member moved upward; and a support including a bracket and at least one support body disposed on one side of the bracket; an insertion hole being formed on the bracket; the bracket of the support being rotatably mounted in the space of the main body and positioned under the insertion pin, whereby when the operation member is moved downward, a bottom end of the insertion pin is inserted into the insertion hole to fix the support and when rotating the operation member to move the engagement block into the annular groove, the operation member is latched with the main body.

2. The foot support device as claimed in claim 1, wherein when the engagement block is positioned in the opening of one side of the main body, the engagement block is stopped by two sidewalls of the opening.

3. The foot support device as claimed in claim 1, wherein a stop flange is formed on a circumference of the main body, whereby when the operation member is moved upward, the engagement block is stopped by the stop flange.

4. The foot support device as claimed in claim 2, wherein a stop flange is formed on a circumference of the main body, whereby when the operation member is moved upward, the engagement block is stopped by the stop flange.

5. The foot support device as claimed in claim 3, wherein a top board is disposed at a top end of the main body and a circumference of the top board forms the stop flange; the insertion pin passing through the top board.

6. The foot support device as claimed in claim 1, wherein the operation member has a top wall; a top end of the insertion pin being connected with the top wall of the operation member; two ends of the elastic member abutting against a top end of the main body and the top wall of the operation member respectively.

7. The foot support device as claimed in claim 1, wherein the operation member further includes a top cap and a pin member; the top cap being disposed at the top end of the operation member; a socket being formed under a bottom side of the top cap; a top end of the insertion pin being fitted in the socket, the pin member passing through the circumferential wall of the operation member, the top cap and the top end of the insertion pin.

8. The foot support device as claimed in claim 1, further comprising two restriction members disposed on the bracket of the support and positioned on the two sides of the main body respectively.

9. The foot support device as claimed in claim 1, wherein a recess is formed on each of the two sides of the main body, an inner wall face of the recess being formed with a stepped section; the foot support device further comprising two restriction members disposed on the bracket of the support and positioned on the two sides of the main body respectively, inner ends of the restriction members respectively extending into the recesses to abut against the stepped sections.

10. The foot support device as claimed in claim 1, wherein the support includes two support bodies fixedly disposed at two ends of the bracket, the support bodies being forward and backward arranged on one side of the bracket.

11. The foot support device as claimed in claim 10, wherein the support bodies are substantially barrel-shaped bodies having an arched form.

12. The foot support device as claimed in claim 10, wherein the two support bodies have different outer diameters.

13. The foot support device as claimed in claim 11, wherein a front support body of the two support bodies has a smaller outer diameter, while a rear support body has a larger outer diameter.

14. The foot support device as claimed in claim 1, wherein when the support body is horizontally positioned, the insertion hole is vertically positioned.

15. The foot support device as claimed in claim 1, wherein the seat section is a rod.

16. A foot support device comprising:

a main body, a space being formed in the main body, two sides of the main body being located on opposing sides of the main body; each of the two sides of the main body is formed with an opening communicating with the space; a seat section being disposed at a bottom end of the main body;

an operation member, which is a sleeve member, an insertion pin being disposed in the operation member, the operation member being fitted around the main body, the operation member being movable downward along the main body to an insertion position or upward along the main body to a released position; and a support including a bracket and at least one support body disposed on one side of the bracket; an insertion hole being formed on the bracket; the bracket of the support being rotatably mounted in the space of the main body and positioned under the insertion pin, when the operation member is moved downward to the insertion position, a bottom end of the insertion pin being inserted into the insertion hole to fix the support, the operation member being latchable with the main body to keep the operation member in the insertion position; when the operation member is moved upward to the released position, the insertion pin being moved out of the insertion hole.

17. The foot support device as claimed in claim 16, wherein an annular groove is formed on an outer circumference of the main body and at least one engagement block is disposed on an inner circumference of the operation member, whereby when the operation member is moved downward to the insertion position, the operation member can be rotated to move the engagement block into the annular groove so as to latch the operation member with the main body.

18. The foot support device as claimed in claim 16, wherein the support includes two support bodies fixedly disposed at two ends of the bracket, the support bodies being forward and backward arranged on one side of the bracket.

19. The foot support device as claimed in claim 18, wherein the support bodies are substantially barrel-shaped bodies having an arched form.

20. The foot support device as claimed in claim 16, wherein when the support body is horizontally positioned, the insertion hole is vertically positioned.

* * * * *